US008668359B2

(12) United States Patent
Welén

(10) Patent No.: US 8,668,359 B2
(45) Date of Patent: Mar. 11, 2014

(54) FIXTURE FOR EMULATION OF OMNIDIRECTIONAL OR DIRECTED CONTINUOUS LIGHTING

(76) Inventor: Patrik Welén, Visbo (SE)

( * ) Notice: Subject to any disclaimer, the term of this patent is extended or adjusted under 35 U.S.C. 154(b) by 234 days.

(21) Appl. No.: 13/132,722

(22) PCT Filed: Dec. 2, 2009

(86) PCT No.: PCT/SE2009/051366

§ 371 (c)(1),
(2), (4) Date: Sep. 16, 2011

(87) PCT Pub. No.: WO2010/064984

PCT Pub. Date: Jun. 10, 2010

(65) Prior Publication Data

US 2011/0316438 A1 Dec. 29, 2011

(30) Foreign Application Priority Data

Dec. 4, 2008 (SE) ..... 0802526

(51) Int. Cl.
*F21V 21/26* (2006.01)

(52) U.S. Cl.
USPC ..... 362/269; 362/275; 362/287

(58) Field of Classification Search
USPC ..... 362/257, 269–275, 285–289
See application file for complete search history.

(56) References Cited

U.S. PATENT DOCUMENTS 6,002,505 A * 12/1999 Kraenert et al. ..... 359/196.1
6,220,727 B1 * 4/2001 Chang ..... 362/284
6,412,972 B1 * 7/2002 Pujol et al. ..... 362/272
2002/0021569 A1 * 2/2002 Beliveau ..... 362/223
2002/0176055 A1 * 11/2002 De Vaan et al. ..... 353/31
2006/0002109 A1 * 1/2006 Imade ..... 362/231
2006/0279708 A1 * 12/2006 Silverstein et al. ..... 353/84
2008/0106703 A1 * 5/2008 Miyazawa ..... 353/84
2009/0268484 A1 * 10/2009 Kim et al. ..... 362/608

FOREIGN PATENT DOCUMENTS

CN 201162988 Y 12/2008
DE 101 16 884 A1 10/2001
DE 102 37 751 A1 2/2004
WO 2008/108623 A1 9/2008

OTHER PUBLICATIONS

International Search Report for corresponding International Application No. PCT/SE2009/051366 mailed Mar. 16, 2010.

Written Opinion of the International Searching Authority for corresponding International Application No. PCT/SE2009/051366 mailed Mar. 16, 2010.

* cited by examiner

*Primary Examiner* — Jason M Crawford

(74) *Attorney, Agent, or Firm* — Renner, Otto, Boisselle & Sklar, LLP

(57) ABSTRACT

A fixture for providing omnidirectional continuous lighting comprises a light source (10). an optical system (20) adapted to concentrate, direct and shape an incident into an output slit beam, a motor (30) coupled to a revolvable part (25) of the optical system (20), thereby enabling rotation of the output slit beam, around a rotational axis (y), with such an angular velocity (ϕ) and in such a manner that the provided lighting appears continuous to a spectator.

15 Claims, 5 Drawing Sheets

FIXTURE FOR EMULATION OF OMNIDIRECTIONAL OR DIRECTED CONTINUOUS LIGHTING

This application is a national phase of International Application No. PCT/SE2009/051366 filed Dec. 2, 2009 and published in the English language, which claims priority to Application No. SE 0802526-4 filed Dec. 4, 2008.

TECHNICAL FIELD

The present invention relates to a lighting fixture for omnidirectional lighting that appears continuous to a spectator.

BACKGROUND

Artificial lighting is a prerequisite for human societies of today, and the properties and quality of the lighting has a great impact on the well-being of the people who are exposed. A vast terminology and set of parameters are used to define light and lighting, but the following non-exhaustive list can be used to describe the light source itself.

Natural sunlight has a continuous white light spectrum. The color rendering index, CRI, of a light source is a quantitative measure of its ability to replicate the colors of various objects faithfully in comparison with natural sunlight. It is measured as a percentage. This means that a CRI of 100%, taken at a color temperature of noon sunlight, approximately 6000 K, will exactly reproduce the colors found on a sunny day at noon. Light sources with a high CRI are desirable in color-critical applications such as e.g. photography or inspection of processing in e.g. the food industry.

Optical phenomena are also influencing perception of light and lighting. The document DE 10237751 A1 refers to the "slowness of the eye" as the phenomenon responsible for the eye not perceiving the flickering of the light source. This is a common but unfortunate misunderstanding. That is the "apparent movement" phenomenon in action, which makes still pictures, projected one after another at a certain frequency appear to move, as in "the movies". This phenomenon occurs at about 25-30 Hz. However, anyone who has ever seen a silent movie knows that the light intensity is still visibly flickering at that frequency. The slowness of the eye is what makes the eye unable to perceive the variable intensity of a light source flickering with a certain frequency. The critical flickering frequency, CFF, occurs at about 60 Hz. However, even though the eye may not be able to perceive the flickering, "visual evoked potentials", can occur, in which case flickering over the CFF may still be very tiresome for the brain and the nervous system. The usual fluorescent lamp run on 50-60 Hz can be very tiresome and is unsuited for workplaces e.g. According to the certification TCO'99©, the refresh frequency of a computer screen must be ≥85 Hz.

Somewhere between 80-120 Hz the visual evoked potentials disappear. All limits are individual and dependant upon e.g. age and health status, and also what kind of task is performed. A lighting that is truly healthy for all people and appropriate for all kinds of tasks should therefore exceed 120 Hz.

Besides these physical and physiological properties and limitations, certain EU directives, such as the Restriction of Hazardous Substances (RoHS) and the Waste Electrical and Electronic Equipment (WEEE) directives, put restrictions on electrical and electronical equipment, including equipment for lighting. For example, the RoHS directive forbids the use of e.g. lead and mercury. These directives are a part of the common EU law and constitute imperative demands on environmental compliance product development for the electronics industry.

Light pollution occurs when excessive amounts of artificial light is used, or when the light source is inadequately shielded, thus providing undesired lighting. Across the planet, the availability of so much artificial light has altered the habits of many animals. Many species are e.g. tricked into migrating early or late because of artificial lights interpreted to be sunlight, or starlight. The stray light also interferes with astronomers' possibility to make observations in populated areas. This unnecessary spreading of light can cost as much as 10 MUSD in the US alone, according to the International Dark-Sky Association.

A report released by the U.S. Department of Energy recommends that LED exterior lighting fixtures emit no light above 90°. The government of the Veneto region of northeastern Italy has prohibited upward-pointing lights.

The common, incandescent, light bulb produces immediate light, and because of its incandescence, it has a continuous spectrum and a CRI of 100%. From an economic and environmental point of view, the low light yield ~5% and short lifetime are disadvantages. In addition, it must be waste sorted according to the WEEE. The halogen light bulb has a marginally higher light yield, but its light flux must be shielded and the bulb becomes very hot, and can thus not be placed anywhere because of the risk of fire.

The excitations of the fluorescent lamp generate UV light that must be converted to visual light through the Stokes shift. Further, the discontinuous spectrum must be compensated for, and the light usually must be shielded in order to be of use. Therefore the effective conversion of a fluorescent lamp is much lower than the theoretical 40%. In addition to this, fluorescent lamps contain mercury, which is listed in the RoHS directive. The so called compact fluorescent lamps feature a distinct delay of several minutes between power-on and full operation, and its conversion efficiency is down to some 25%, which makes it inappropriate for spaces such as restrooms or stairwells.

The light emitting diode or LED as it is henceforth called, has a conversion efficiency of some 50% and a lamp life of over 100 000 h. They do not contain hazardous substances listed in the RoHS or WEEE directives. A so called power LED can endure higher voltages and emit light with higher intensity than previous LED generations. LED's give immediate light; they are compact, robust and relatively inexpensive. Using the LED as a light source for lighting fixtures however, is impaired by a number of problems. First of all, an LED, contrary to a light bulb, does not give omnidirectional light, but the majority of its luminous flux radiates in a certain direction. Although a LED may lend itself to light indicators or selective lighting, generating an even flux of light over a large area is difficult with an LED.

The patent document WO 2008/108623A1 discloses a LED based lighting fixture with a standard socket, where the LED's, distributed over five facets of a stationary cube, are powered according to a certain sequence, aiming at emulating continuous non-directive lighting. It cannot emulate omnidirectional lighting, though, since there are no LED's in the sixth facet. Furthermore, there will always be a variation in the intensity distribution in different space angles, since the LED's are not sufficiently evenly or sufficiently densely distributed over the spherical coordinate system.

DE 10237751 discloses a lighting fixture using a white solid state laser as a light source. The light is guided through an optical system comprising mirrors and lenses. Mounted on the shaft of an electric motor, the optical system is rotated to emulate distributed lighting. White solid state lasers typically have a 10% conversion efficiency, which means that this fixture does little to conserve energy. Moreover, to work, the construction is dependent upon "light leaving the aperture collected as a fine beam", i.e. a laser.

All lasers, as opposed to other light sources, emit collimated, concentrated and coherent light. Even if a laser beam is subsequently diffused, the light remains coherent, and is therefore always potentially harmful. The International Electrotechnical Commission's 60825-1 standard Safety of laser products, classifies lasers with an out power of 1.5 W as a class 4 laser. According to the Swedish Radiation Safety Authority, this means that just looking at an illuminated spot may be dangerous. Lasers used for surgery and metal cutting belong to class 4. Fixtures combining lasers and lenses, are therefore not appropriate for lighting. Moreover, a laser entails a construction of a certain size, inherently and because of the cooling required due to poor energy conversion of a laser. Therefore, such constructions are unlikely to endure any significant speed of rotation, and particularly, would not endure it for any considerable time.

SUMMARY

It is the object to obviate at least some of the above disadvantages and provide an improved light fixture.

An aspect of the invention comprises a fixture for providing lighting comprising a light source 10, an optical system 20 adapted to direct and shape an incident beam of light from the light source 10 into an output slit beam, a motor 30 coupled to a revolvable part 25 of the optical system 20, thereby enabling rotation of the revolvable part 25, and accordingly the output slit beam, around a rotational axis y, with such an angular velocity $\phi$ and in such a manner that the provided lighting appears continuous to a spectator, characterized in that a stationary part 21 of the optical system 20 comprises a concentrating element 21 adapted to concentrate light from the light source 10.

The concentrating element 21 may be a spherical lens, such as e.g. a ball lens or a double-sided Fresnel lens.

The directing element 26 directs the light beam and may achieve a beam inclination 70 relative the rotational axis y. The inclination 70 may be 90° relative the rotational axis y, or it may be smaller than or larger than 90° relative the y axis. The directing element 26 may direct the light beam with the use of internal reflection. The directing element 26 may then be a prism with a triangular cross section, alternatively a semicircular cross section.

The revolvable part 25 comprises a shaping element 26, which may be an oval-cylindrical lens. The shaping element 26 shapes an output beam into a slit beam.

The optical system 20 may be configured to shape an output beam so that an angular width 60 is 1-3° in a plane perpendicular to the rotational axis y.

The optical system 20 may be configured to shape an output beam so that an angular height 62 is up to 180° in a plane parallel to the rotational axis y.

The light source 10 may comprise two LED's, one of which has light characteristics different from the other one. They may have differences in color, intensity, radiation pattern, spectral distribution etc.

The control circuit 40 may be configured to deliver a pulse modulated feed current to the light source 10. Further the circuit 40 it is configured to synchronize a pulse frequency of the feed current with the angular velocity $\phi$ so that the light source 10 is recurrently activated in the same at least one rotational angle $\theta_0$, thereby recurrently illuminating a corresponding at least one sector $S_{\theta=0}$ of the environment.

The control circuit 40 may further be configured so that the light source 10 is recurrently activated in at least two rotational angles $\theta_n$, $\theta_{n+1}$, in such a way that each corresponding recurrently illuminated sector $S_n$, $S_{n+1}$ is adjacent to at least one other recurrently illuminated sector $S_\theta$.

The control circuit 40 is further configured so that the light source 10 is recurrently activated in multiple rotational angles $\Sigma\theta$, in such a way that each corresponding recurrently illuminated sector $S_n$ is adjacent to two other recurrently illuminated sectors $S_{n-1}$, $S_n$, $S_{n+1}$, thus illuminating the entire periphery $\Sigma S$.

BRIEF DESCRIPTION OF THE DRAWINGS

In order to explain the invention in more detail an embodiment will be described in detail below, reference being made to the accompanying drawings, in which.

DETAILED DESCRIPTION

Figure 1:
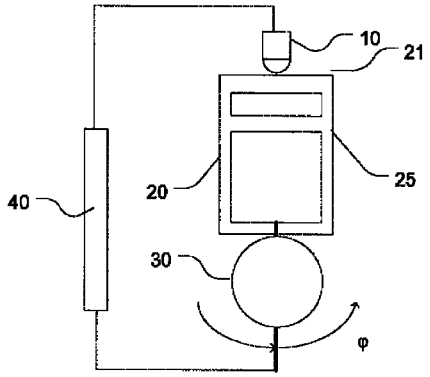
FIG. 1 is a schematic view of components comprised within the lighting fixture.

The fixture in which embodiments of the invention are implemented will now be described in relation to FIG. 1. FIG. 1 schematically shows the components comprised in the lighting fixture, namely a light source 10, an optical system 20, a motor 30 and a control circuit 40. The optical system 20 is adapted to direct and shape an incident beam of light from the light source 10 into an output slit beam. The optical system 20 comprises a stationary part 21 and a revolvable part 25. The stationary part 21 is adapted to concentrate light from the light source 10. The revolvable part 25 is adapted to direct and to shape an output light beam, and is mounted on the shaft of an electric motor 30. The motor 30 is coupled to the revolvable part 25 in a way that enables it to rotate around an axis. When rotating with applicable angular velocity $\phi$, the resulting lighting appears continuous to a spectator. The optical system 20 may be hermetically enclosed to avoid condensation or deposits that would otherwise impair the light yield and the life of the fixture.

Figure 2:
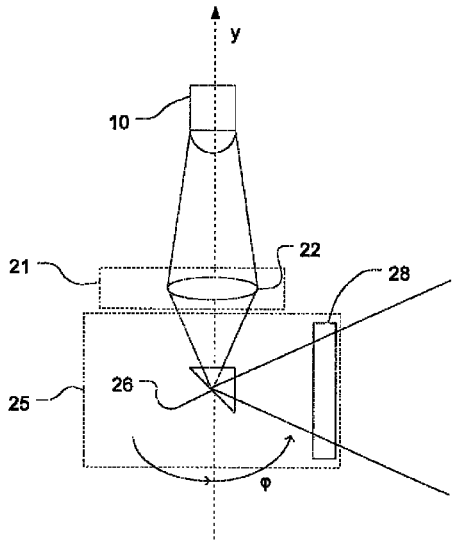
FIG. 2 is a schematic view of the beam path through an optical system.

As described in FIG. 2, the stationary part 21 of the optical system 20 comprises a concentrating element 22, placed and arranged in such a way that incident light from the light source 10 can be concentrated, reducing the cross sectional area of the light beam to a minimum. The incident light may be deflected radially inward. The concentrating element 22 may be a spherical lens. It may be a ball lens or alternatively a double sided Fresnel lens or some combination of different lens types. In one embodiment the concentrating element 22 may be mounted tight to a power LED comprised in the light source 10. Since the concentrating element 22 is stationary, it is less sensitive to mechanical strain induced by e.g. angular velocity. The immobility also enables use of a concentrating element 22 large enough to capture light from a relatively large single light source 10, a light source 10 with very divergent light or a bundled light source 10.

Figure 4:
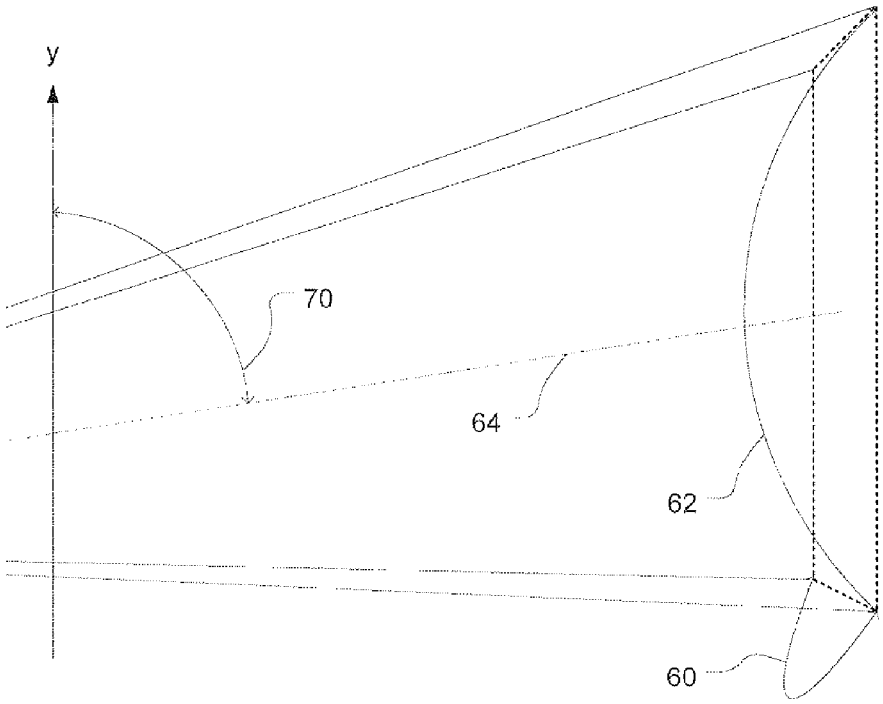
FIG. 4 illustrates geometrical properties of the resulting slit beam.

The revolvable part 25 of the optical system 20 further comprises a directing element 26 and a shaping element 28. The directing element 26 achieves a beam inclination 70 (FIG. 4) relative the rotational axis y.

Figure 3A:
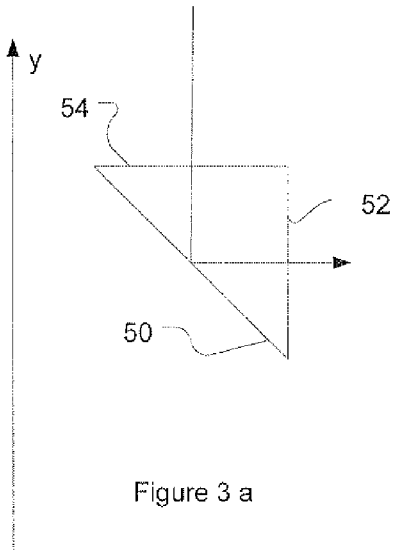
FIG. 3 shows alternative directional elements.

According to one embodiment the directing element 26 may be a prism. The prism may have a cross-section in the form of a right-angled, isosceles triangle, as depicted in FIG. 3*a*. The prism uses internal reflection in a surface 50 to direct the light. The angle of incidence of a light beam to the reflecting surface 50 may be 45° or another angle at which total reflection will occur in a material of which the prism is made. Consequently there are no reflection losses in the surface 50.

Figure 3B:
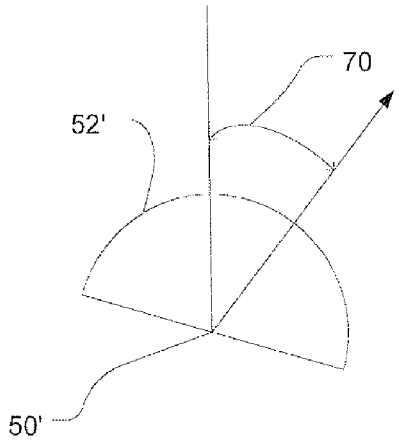

With a 45° incidence angle, the output beam inclination 70 is 90°. The beam may then propagate through the interfaces 52 and 54 of the prism with a 0° angle of incidence, and therefore the refraction losses are negligible. In an alternative embodiment, the prism may have the cross-section of a semicircle as depicted in FIG. 3*b*. The curved surface 52' then enables pivoting around the semicircles corresponding center giving the beam a variable inclination 70 relative the y axis, while maintaining 0° incidence in 52'. As long as the angle of incidence in 50' exceeds the critical angle above which total reflection occurs, there are no reflection losses in 52'. This embodiment increases the degrees of freedom so that the beam can be directed with optional inclination 70. It enables exterior lighting fixtures that do not emit light above 90° in compliance with U.S. Department of Energy recommendations.

The beam may have its focal point in or sufficiently near the directive surface 50 to allow all incident light to hit the surface 50, not spilling light over the edges. This concentration makes it possible to use a very small directing element 26, typically a few millimeters. It also eliminates the need for a divergent lenses etc. in order to widen the beam after reflection. As a comparison, the fixture disclosed in D2 features a divergent lens as input lens, and a large mirror.

As seen in FIG. 5, the shaping element 28, at which the light is directed, compresses the output horizontal angular width 60, while the vertical angular width 62 may be virtually unchanged, thereby shaping an output slit beam, that is, the cross section of the beam is vertically compressed toward its line of symmetry 64 into a thin slit. The shaping element 28 may be an oval-cylindrical lens, and it may be adapted to generate an angular width 60 of 1-3 degrees. The optical system 20 may be configured to shape an output beam with an angular height 62 up to 180°. The shaping lens 28 and the directing element 26 are fix relative each other, but are revolvable around an axis y.

With the revolvable parts at rest, a spectator will only see the slit beam or rather the thin slit of beam light reflected by the environment. In order to emulate omnidirectional lighting, the revolving part 25 must rotate around the y-axis with an adequate angular velocity $\phi$. In order to do so, the elements 26 and 28 have very little mass and volume. In one embodiment of the invention the motor 30 to which the revolvable part 25 is mounted, is a DC-motor that has low self-friction and high power efficiency. The motor 30 may easily achieve an angular velocity $\phi$ corresponding to 8000 rpm and above.

Any kind of reasonably directional light source may be used in a fixture according to embodiments of the invention. In one embodiment, the light source 10 is a LED, it may well be a power LED, which has high conversion efficiency, typically ~90%, and which consequently generate very little heat. One of two LED's comprised within the light source 10 may have characteristics different from the other one; characteristics such as chromatic composition, spectrum, luminance, radiation pattern etc.

The LED arrangement may comprise a white LED and a colored LED so as to enable color temperature adjustable white light. A white LED is a monochromatic, blue or UV, LED using phosphor to make a Stokes shift conversion to broad-spectrum white light. Due to this conversion, and other phosphor-related degradation issues, a white LED typically has lower efficiency than normal LED's. Therefore, alternatively, the LED arrangement 10 may comprise monochromatic LED's. An arrangement comprising one red, one green and one blue LED may be used to emulate white light. A red LED may be used during photographic printing, so as not to spoil the photo paper. Varying the intensity of one of the monochromatic LED's will adjust the color temperature. Instead of a power LED, an arrangement of low-power LED's can be used to achieve high-intensity lighting. These alternative embodiments give the distinct advantage of enabling compliance to various requirements, purposes, needs and wishes.

Figure 5A:
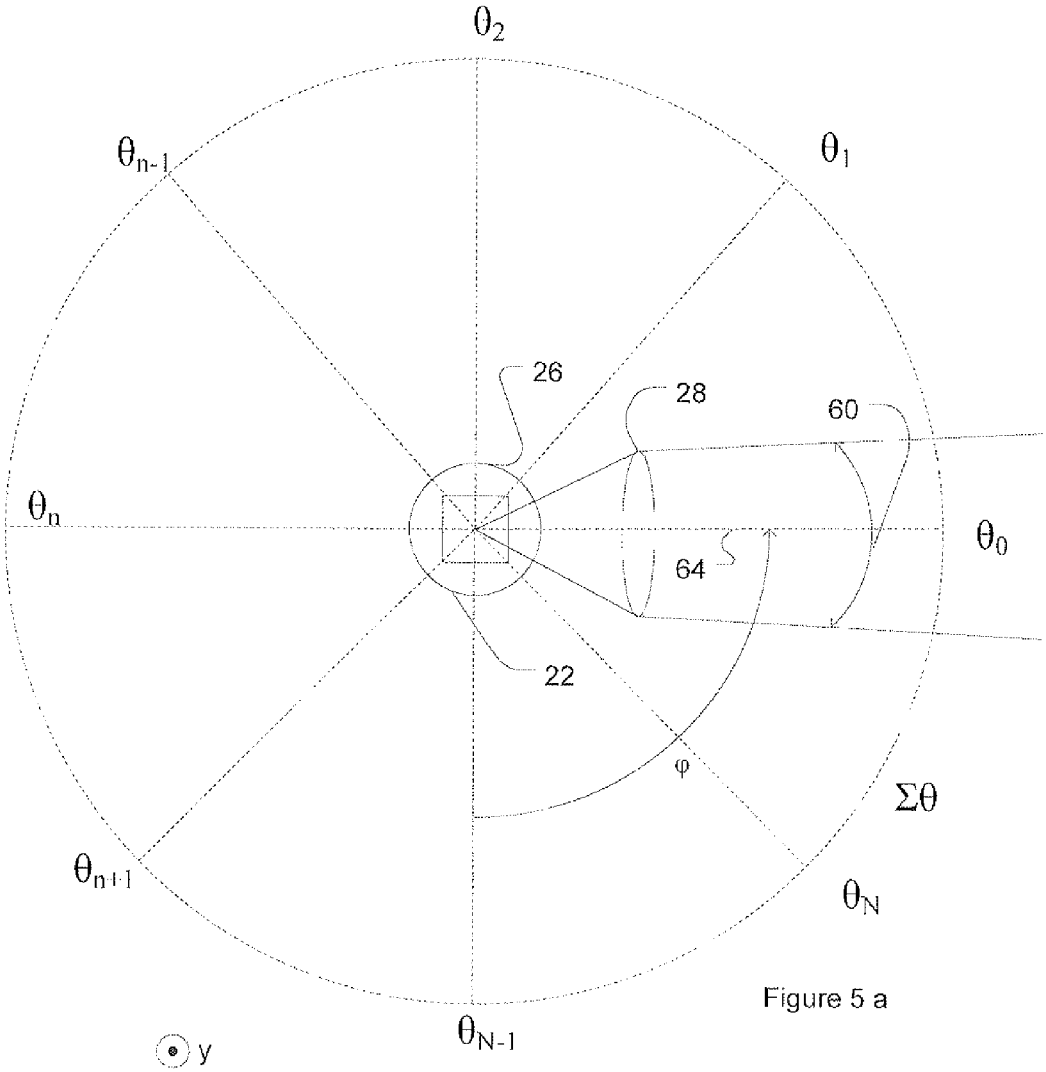
FIG. 5 is a set of top views illustrating rotational angles and corresponding illuminated sectors.
Figure 5B:
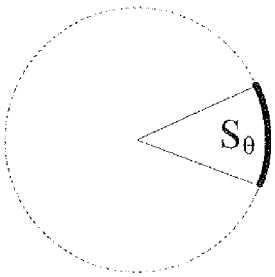
Figure 5C:
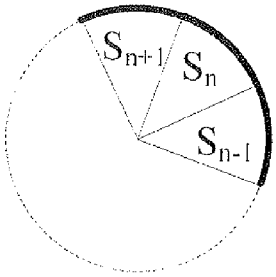

In order to further increase the experienced intensity, and thereby efficiency, the control circuit 40 may deliver a pulse modulated feed current to the light source 10. As illustrated in FIGS. 5*a* and 5*b*, the control circuit 40 may be configured to synchronize a pulse frequency p of the feed current with the angular velocity $\phi$ so that the light source 10 is recurrently activated in the same rotational angle $\theta_0$, thereby recurrently illuminating a corresponding sector $S_{\theta=0}$ of the environment.

Figure 5D:
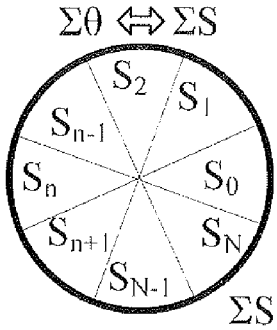

In one embodiment the number of pulses per lap is as many as the rotational angles $\theta_{1\ to\ N}$ in which the light source 10 may be activated. $\phi$ is synchronized with the pulse frequency p so that each recurrently illuminated sector $S_n$ is adjacent to two other recurrently illuminated sectors $S_{n-1}$ and $S_{n+1}$. Hence, all sectors $S_\theta$ to $S_N$ are illuminated. This embodiment enables emulation of omnidirectional lighting, as illustrated in FIG. 5*d*.

In one embodiment of the invention, the control circuit 40 is adapted to generate a pulse train where certain pulses are suppressed. Hereby only certain sectors $S_\theta$ are illuminated, not the full lap. As illustrated in FIG. 5 *b*, the light source 10 is recurrently activated in at least two rotational angles $\theta_n$, $\theta_{n+1}$, in such a way that each corresponding recurrently illuminated sector $S_n$, $S_{n+1}$ is adjacent to at least one other recurrently illuminated sector. It is thus possible to use the control circuit to adjust the size of the illuminated area not by adjusting the optical system, but by deciding what consecutive sectors $S_{n-1}$, $S_n$, $S_{n+1}$, $S_{n+}$ . . . should be illuminated. Other sectors $S_\theta$ remain unlighted, not due to shielding, but because no pulses are triggering the light source 10 at the corresponding rotational angles $\theta$. This embodiment enables adaptive vehicle lighting. Compared to the lighting fixture of the WO document referred to above, adaptive vehicle lighting according to an embodiment of this invention has no shielding losses, and no oscillations, which would otherwise put a lot of mechanical strain on the fixture, and would also generate unnecessary superpositions of light in the extreme points of the oscillation.

In one embodiment, the illuminated sectors $S_\theta$ may be slightly overlapping, the superimposed light thus compensating for decreasing flux at the edges of the output beam.

As an example, the control circuit 40 may generate a square wave feed current and it may have a pulse frequency p and a duty cycle of 1/10. The angular velocity $\phi$ of the motor 30 may be 8000 rpm or ~133 Hz. In known implementations of pulse width modulated intensity control, the absolute pulse length is being varied, while the pulse frequency is kept constant. The principle according to which the present invention functions is based on varied illumination pulse frequency, identical to $\phi$, and related to but not identical with the pulse frequency p. The angular velocity $\phi$ can thus be modulated for effect. For omni-directional lighting with N illuminated rotational angles $\theta$, $\phi$ is related to p as $p=\phi*N$ If the duty-cycle of the feed current is 10%, the duty-cycle of the illumination in each sector is 0.28%, assuming N=360

Known pulse width modulation circuits for intensity control of LED's use a feed current duty cycle resolution=illumination duty cycle of 1%, and hence cannot re-create the effect demonstrable with a lighting fixture according to an embodiment of this invention.

In order to achieve the above described effect, the circuit may be able to deliver square pulses that are distinct enough, i.e. have applicable resolution, with a pulse frequency p which is in constant proportion to the angular velocity $\phi$, but which can vary the feed current duty cycle so that the absolute pulse length is constant while angular velocity $\phi$ and pulse frequency p are synchronized.

Laboratory experiments have shown that very short and distinct fixed pulse lengths in good proportion to the lap time can obtain a correlated measurable effect between $\phi$ and perceived illumination. By utilizing this effect, the emulated experienced lighting intensity can be varied through varying the illumination pulse frequency, with higher light yield than a conventional PWM LED fixture.

The circuit 40 that delivers the feed current comprises a low-power stage where a comparator switches on and off and N-HEX transistor at a voltage threshold t and an output stage that delivers a square wave with an appropriate pulse frequency p and duty cycle.

Figure 6:
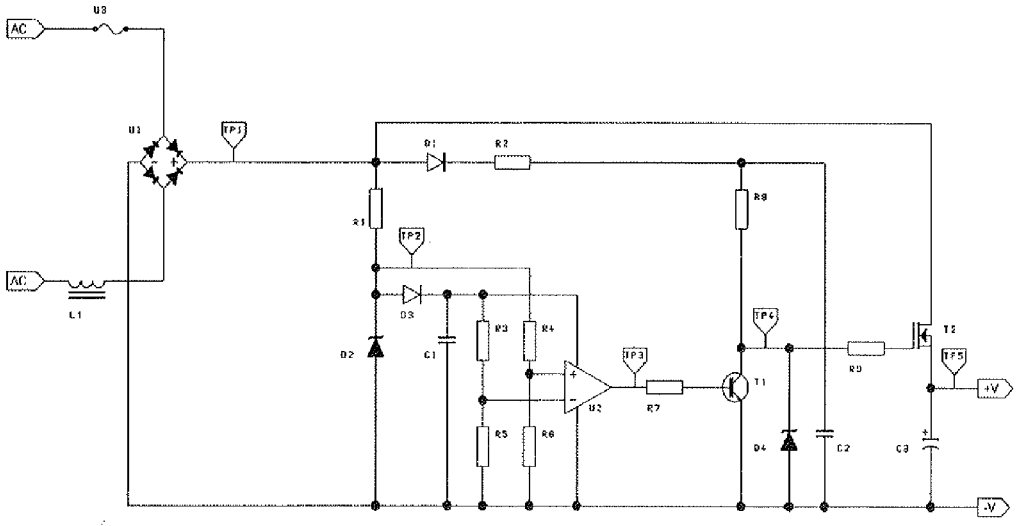
FIG. 6 discloses the circuit diagram of a low-power stage.

FIG. 6 discloses the circuit diagram of the low-power stage in the form of an AC/DC converter. The AC/DC converter has a wide input voltage range appropriate for low-power stages for currents up to 350 mA. The basic principle is that a fast and current-saving comparator switches the N-HEX transistor on and off at a certain voltage threshold. If the low-power stage is connected to a source of sinus current with a frequency of e.g. 50 Hz, the input voltage range can be allowed to vary between 9 VAC-270 VAC. The low-power stage also has the ability to solve voltage transients which normally occurs in a power mains system.

Figure 7:
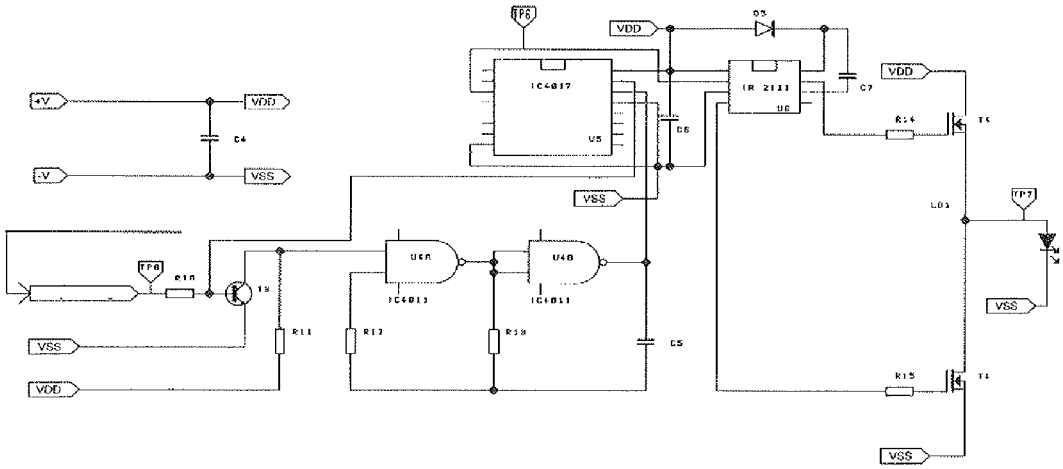
FIG. 7 discloses the circuit diagram of an output stage.

FIG. 7 discloses the circuit diagram of the output stage that is comprised within the control circuit 40. The output stage is generating a square wave with a duty cycle synchronized with the angular velocity $\phi$. Every time the motor's axis of rotation passes a start marking representing a new lap, the pulse trigger of the pulses to the light source 10 is also reset.

This synchronization enables the slit beam to illuminate the same sector S lap after lap. Further this enables illumination of several consecutive sectors S to be illuminated sequentially, thereby emulating omnidirectional light. The pulse frequency of the pulse wave to the light source 10 is adapted to the angular velocity $\phi$ and to a number of illuminated rotational angles $\theta$.

Figure 8:
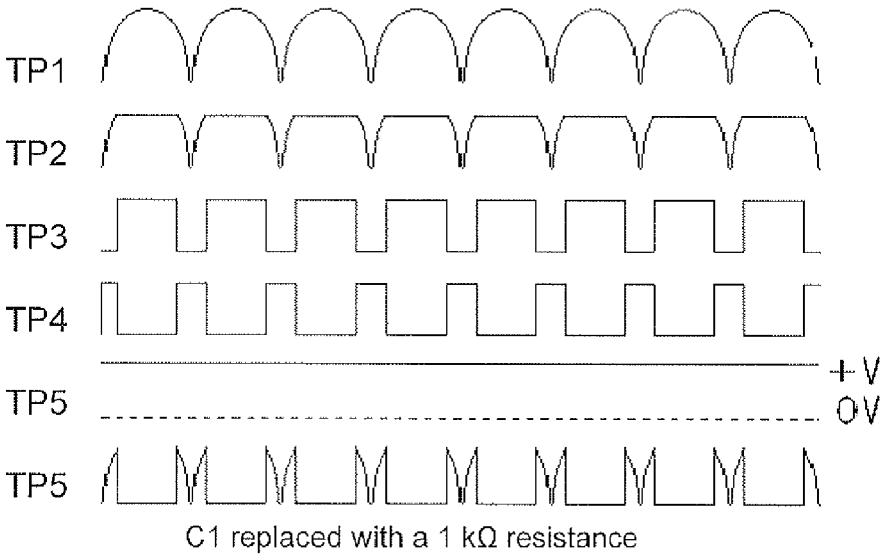
FIG. 8 displays a voltage diagram over test points TP1-8.
Figure 8:
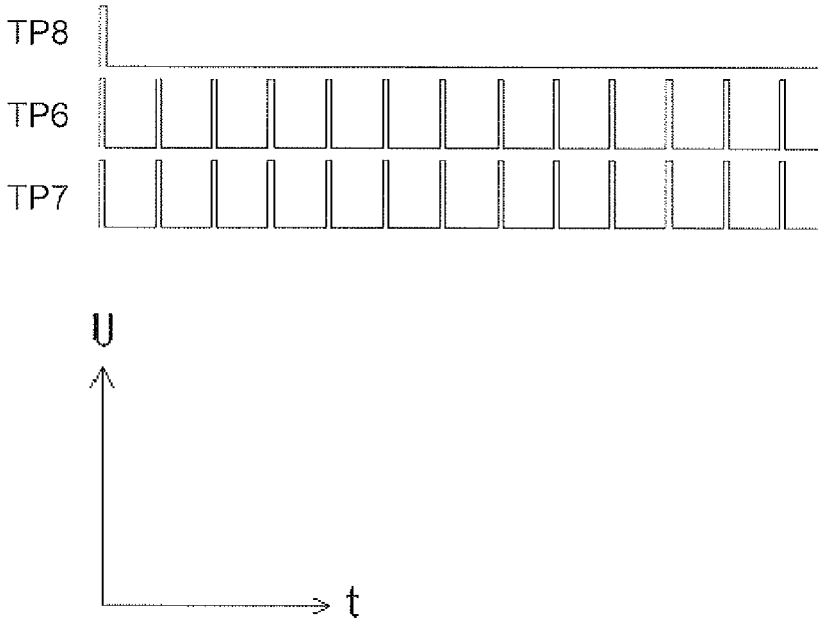

FIG. 8 displays a voltage diagram over test points in the control circuit 40. TP1-TP5 refers to test points denoted in the low-power stage circuit diagram in FIG. 6. TP6-TP8 refers to test points denoted in the output stage circuit diagram in FIG. 7.

Embodiments of the present invention solve a series of different problems, and provide solutions within areas such as general flicker-free lighting for private residences, offices and workshops, but also special lighting adapted for the special needs of industry in terms of intensity, illumination frequency, color and color temperature. Further, embodiments of the invention provide solutions for selective illuminations, e.g. for paintings, work areas, spot lights. It enables adaptive vehicle lighting, where the direction of the light is correlated with the steering system of the car to allow the light beams to direct to where the car is turning. It enables street lighting that does not spill light in unwanted directions, and that does not suffer from shielding losses. It enables collective spot lighting of distributed objects, e.g. paintings on different walls of a room.

In all these applications embodiments of the invention have a distinct advantage compared to known lighting fixtures in that losses due to reflection, refraction and shielding are minimized. This in turn maximizes light yield and minimizes light pollution and dazzling risk. It is also safe, as there is no need for coherent laser light.

The invention claimed is:

1. A fixture for providing lighting comprising a light source, an optical system adapted to direct and shape an incident beam of light from the light source into an output slit beam, a motor coupled to a revolvable part of the optical system, thereby enabling rotation of the revolvable part, and accordingly the output slit beam, around a rotational axis (y), with such an angular velocity ($\phi$) and in such a manner that the provided lighting appears continuous to a spectator, characterized in that a stationary part of the optical system comprises a concentrating element adapted to concentrate light from the light source and a control circuit configured to deliver a pulse modulated feed current to the light source and to synchronize a pulse frequency of the feed current with the angular velocity ($\phi$) so that the light source is recurrently activated in the same at least one rotational angle ($\theta_0$), thereby recurrently illuminating a corresponding at least one sector ($S_{\theta=0}$) of the environment.

2. The lighting fixture according to claim 1, wherein the concentrating element is a spherical lens.

3. The lighting fixture according to claim 2, wherein the concentrating element is a ball lens.

4. The lighting fixture according to claim 1, wherein the revolvable part comprises a directing element that directs the light beam and achieves a beam inclination relative the rotational axis (y).

5. The lighting fixture according to claim 4, wherein the directing clement achieves a 90° beam inclination relative the rotational axis (y).

6. The lighting fixture according to claim 4 wherein the directing clement directs the light beam with the use of internal reflection.

7. The lighting fixture according to claim 6, wherein the directing element is a prism with a triangular cross section.

8. The lighting fixture according to claim 6, wherein the directing element is a prism with a semicircular cross section.

9. The lighting fixture according to claim 1, wherein the revolvable part comprises a shaping clement that shapes an output beam.

10. The lighting fixture according to claim 9, wherein the shaping element is an oval-cylindrical lens.

11. The lighting fixture according to claim 1, wherein the optical system is configured to shape an output beam so that an angular width is 1-3° in a plane perpendicular to the rotational axis (y).

12. The lighting fixture according to claim 1, wherein the optical system is configured to shape an output beam so that an angular height is up to 180° in a plane parallel to the rotational axis (y).

13. The lighting fixture according to claim 1, where in the light source comprises two LED's, one of which has light characteristics different from the other one.

14. The lighting fixture according to claim 1, wherein the control circuit is further configured so that the light source is recurrently activated in at least two rotational angles ($\theta_n$, $\theta_{n+1}$), in such a way that each corresponding recurrently illuminated sector ($S_n$, $S_{n+1}$) is adjacent to at least one other recurrently illuminated sector ($S_\theta$).

15. The lighting fixture according to claim 1, wherein the control circuit is further configured so that the light source is recurrently activated in multiple rotational angles ($\Sigma\theta$). in such a way that each corresponding recurrently illuminated sector ($S_n$) is adjacent to two other recurrently illuminated sectors ($S_{n-1}$, $S_n$, $S_{n+1}$), thus illuminating the entire periphery ($\Sigma S$).

* * * * *

UNITED STATES PATENT AND TRADEMARK OFFICE

CERTIFICATE OF CORRECTION

PATENT NO. : 8,668,359 B2
APPLICATION NO. : 13/132722
DATED : March 11, 2014
INVENTOR(S) : Patrik Welén It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 336 days.

Signed and Sealed this
Twenty-ninth Day of September, 2015

Michelle K. Lee

Michelle K. Lee
*Director of the United States Patent and Trademark Office*